US005211673A

United States Patent [19]

Ditscherlein

[11] Patent Number: 5,211,673

[45] Date of Patent: May 18, 1993

[54] CENTRIFUGAL TREATMENT MACHINE

[75] Inventor: Friedhold Ditscherlein, Bocholt, Fed. Rep. of Germany

[73] Assignee: Friedhold Ditscherlein, Bocholt, Fed. Rep. of Germany

[21] Appl. No.: 794,402

[22] Filed: Nov. 19, 1991

[30] Foreign Application Priority Data

Nov. 30, 1990 [DE] Fed. Rep. of Germany ..... 4038253

[51] Int. Cl.[5] ..... B24B 31/108

[52] U.S. Cl. ..... 51/163.2; 51/164.1; 51/7

[58] Field of Search ..... 51/163.1, 163.2, 164.1, 51/7, 17, 313

[56] References Cited

U.S. PATENT DOCUMENTS

| | | | |
|---|---|---|---|
| 4,030,247 | 6/1977 | Grund et al. | 51/419 |
| 4,498,986 | 2/1985 | Temme et al. | 210/199 |
| 4,850,151 | 7/1989 | Ditscherlein | 51/163.2 |
| 4,884,372 | 12/1989 | McNeil | 51/163.1 |
| 4,939,871 | 7/1990 | Ditscherlein | 51/163.2 |
| 5,046,287 | 9/1991 | Lin | 51/163.1 |
| 5,088,238 | 2/1992 | Lin | 51/163.1 |

FOREIGN PATENT DOCUMENTS

| | | | |
|---|---|---|---|
| 0088237 | 9/1983 | European Pat. Off. . | |
| 0205161 | 12/1986 | European Pat. Off. . | |
| 2516721 | 5/1976 | Fed. Rep. of Germany . | |
| 0024955 | 2/1984 | Japan | 51/164.1 |
| 0024957 | 2/1984 | Japan | 561/163.2 |
| 455555 | 7/1968 | Switzerland . | |
| 659969 | 3/1987 | Switzerland . | |
| 0831570 | 6/1981 | U.S.S.R. | 51/164.1 |
| 2087275 | 5/1982 | United Kingdom | 51/163.2 |
| 2128513 | 5/1984 | United Kingdom | 51/164.1 |

*Primary Examiner*—Robert A. Rose
*Attorney, Agent, or Firm*—A. Thomas S. Safford

[57] ABSTRACT

A centrifugal treatment machine for the mechanical treatment of workpieces in a treatment container having an essentially cylindrical casing which is stationary during operation and a base in the form of a plate or the like mounted coaxially to this and which rotates during operation, the circumferencial rim of base projecting towards the cylindrical casing to form a gap. In order to be able to gently discharge the workpieces treated in the treatment container without pivoting the container, the rotating base has at least one appropriately dimensioned opening which can be closed by means of a co-rotating closure. Furthermore, a receptacle is arranged beneath the base opening for collecting the workpieces and possibly also the treatment means discharged together with the workpieces out of the container.

28 Claims, 3 Drawing Sheets

CENTRIFUGAL TREATMENT MACHINE

Figure 1:
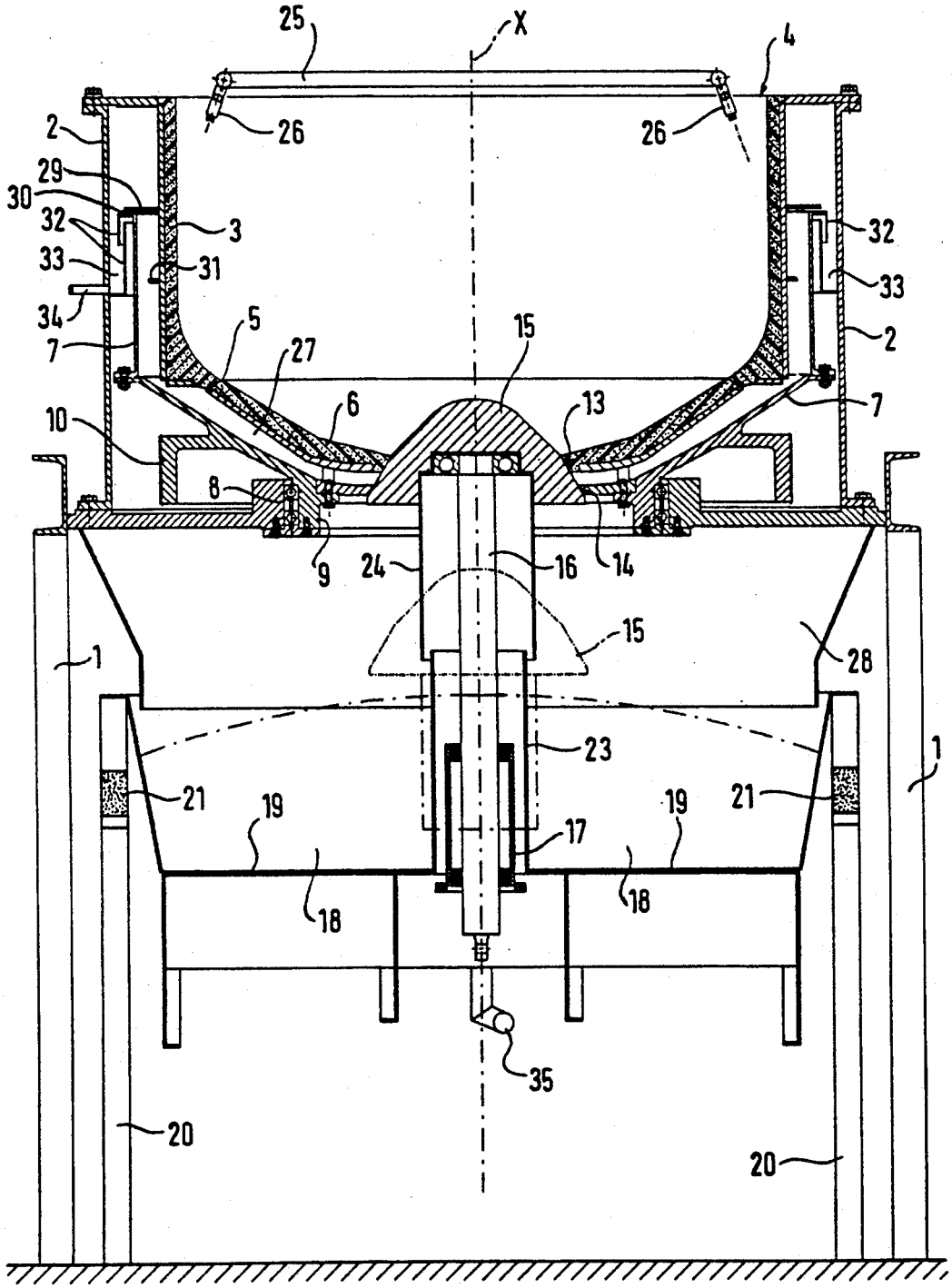

The invention relates to a centrifugal treatment machine for the mechanical treatment, for example grinding, polishing, cleaning and deburring of workpieces in a treatment container having an essentially cylindrical casing which is stationary during operation and a base in the form of a plate or the like mounted coaxially to this which rotates during operation, the circumferential edge of which projects towards the cylindrical casing forming a gap.

In a known centrifugal treatment machine of the type mentioned above, the emptying of the container of workpieces, after their completed treatment and possibly of the grinding means used in this treatment, ensues via a closable opening in the sidewall of the container casing through which the workpieces are slung out of the treatment container by the centrifugal force acting on them during the continued rotation of the container base (DE-A-31 42 868). As the workpieces strike the wall of a provided collecting area with a relatively large centrifugal force, the danger of damage arises particularly with delicate workpieces.

In another known centrifugal machine of this kind (DE-A-36 04 619), the workpieces are discharged from the treatment container after treatment thereof by pouring them out, for which purpose the container open at the top and having a rotatable base and drive is pivoted about a horizontal axis to such an extent that the workpieces possibly also together with the treatment means are guided over the container rim, which has been moved downwards. This emptying of the container has the disadvantage that it requires a complicated pivoting device for the container with its entire rotational drive, and that it inevitably has a large structural height on account of the pivot of the container as well as a large drop for the treated workpieces, which is especially undesirable. As the centrifugal treatment process is mostly a wet process which requires the feed and discharge of liquid (water-compound mixture) and grinding means (chips), feed and discharge pipes must be provided which, together with the required cable connection for the drive and control, must be moved taking the pivot angle into account.

Consequently, it is the object of the present invention to provide a centrifugal treatment machine of the type initially described in such a manner that the workpieces completely treated in its treatment container can be discharged without pivoting the container. This is achieved in accordance with the invention in that the rotating container base has at least one opening dimensioned to allow for the discharge of workpieces out of the treatment container, wherein the opening can be closed by means of a co-rotating closure, and that a receptacle is located beneath the base opening for collecting the workpieces and possibly also the treatment means (liquid and grinding means) discharged together with the workpieces out of the treatment container. By means of such a base opening, the workpieces can be discharged in a gentle manner even for a container base which is stationary or rotating at low revolutions and with a smaller drop, wherein pivoting of the treatment container about the horizontal axis is no longer necessary.

Usually, only one opening is provided for the workpiece discharge which is arranged approximately coaxially to the rotational axis of the base. The closure for this opening can be a raisable and lowerable, mushroom- or umbrella-shaped closure which can be pushed into the discharge opening from below, whereby the support enabling the raising and lowering of the closure can be arranged beneath or above the container base.

In the case of a single discharge opening being arranged approximately coaxially to the rotational axis of the base, the support of the rotating container body cannot ensue by means of a coaxial rotational axis. In this case it is expedient that the rotating container base is rotatably supported by means of a ring bearing mounted on a machine frame which extends about the discharge opening beneath this opening. This decentralized support leads to high support stability of the rotating container base during its rotation, which is particularly advantageous when the ring bearing has an outer diameter which is as close as possible to the outer diameter of the rotating container base. Thus, a constant gap width which is as small as possible can be maintained about the entire base periphery without swinging or oscillation occuring.

As the treatment container in the machine according to the invention does not need to be pivoted about a horizontal axis to empty the same, the treatment fluid flowing through the gap out of the treatment container can be collected by a liquid container located beneath the treatment container. In a particularly advantageous embodiment in which the rotating base of the treatment container is supported and driven in a decentrelized manner on account of the central arrangement of the base opening, the afore-mentioned liquid container which surrounds the treatment container can be securely connected to the rotating base and rotate about the rotational axis of the base. Additionally, this liquid container arranged beneath the rotating base of the treatment container can be provided with at least one opening for the passage therethrough of the workpieces and treatment means to be discharged from this, which opening can also be closed by means of a co-rotating body. This closure can be the same as that provided for closing the opening in the base of the treatment container. In such an arrangement, the support for the rotatable base of the treatment container and the liquid container co-rotating with this can be arranged in such a manner that it does not come into contact with the outflowing treatment fluid (dirty water) so that it does not need to be provided with seals for protecting the supports.

Further useful embodiments of the centrifugal treatment machine according to the invention can be taken from the claims.

Figure 2:
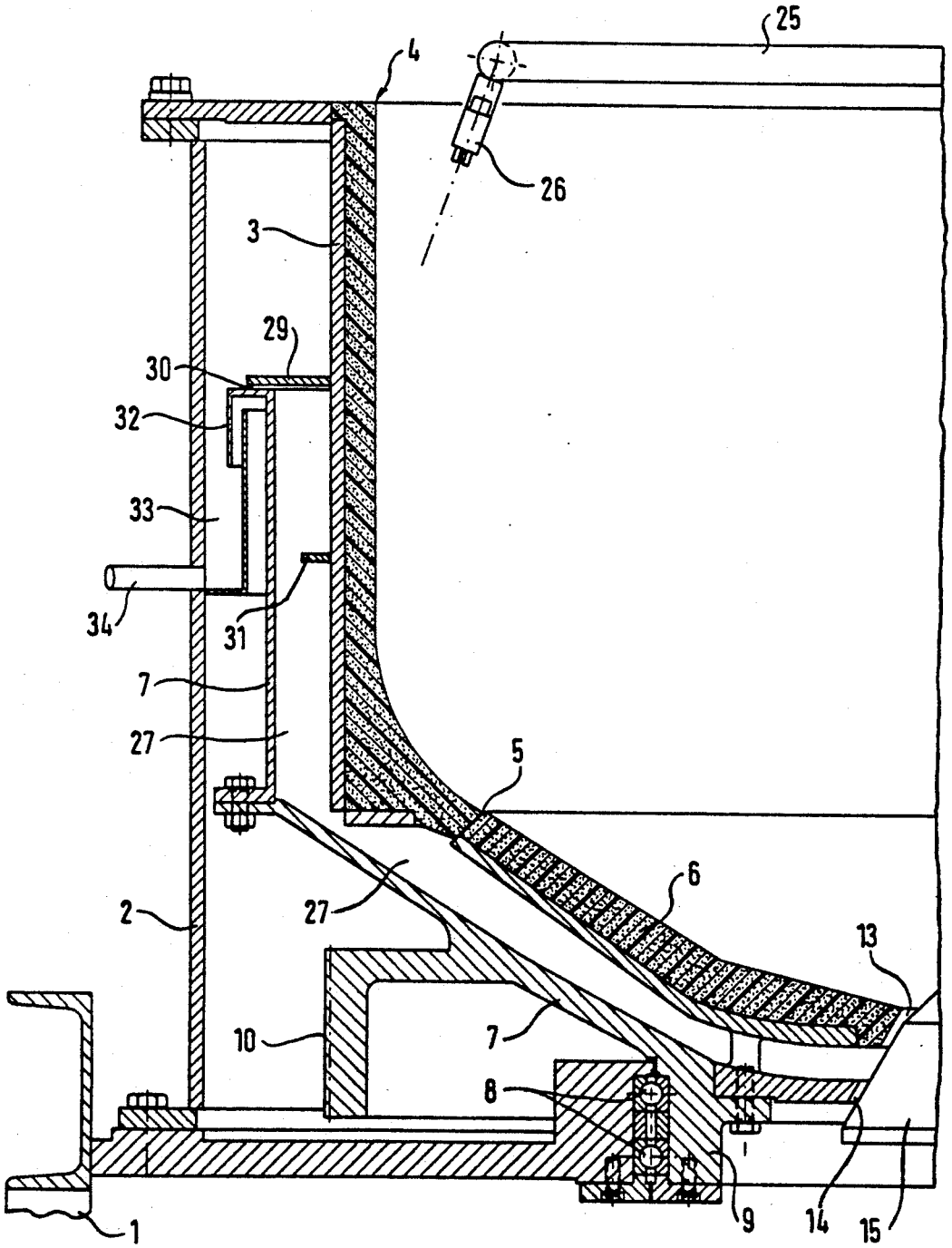
Figure 3:
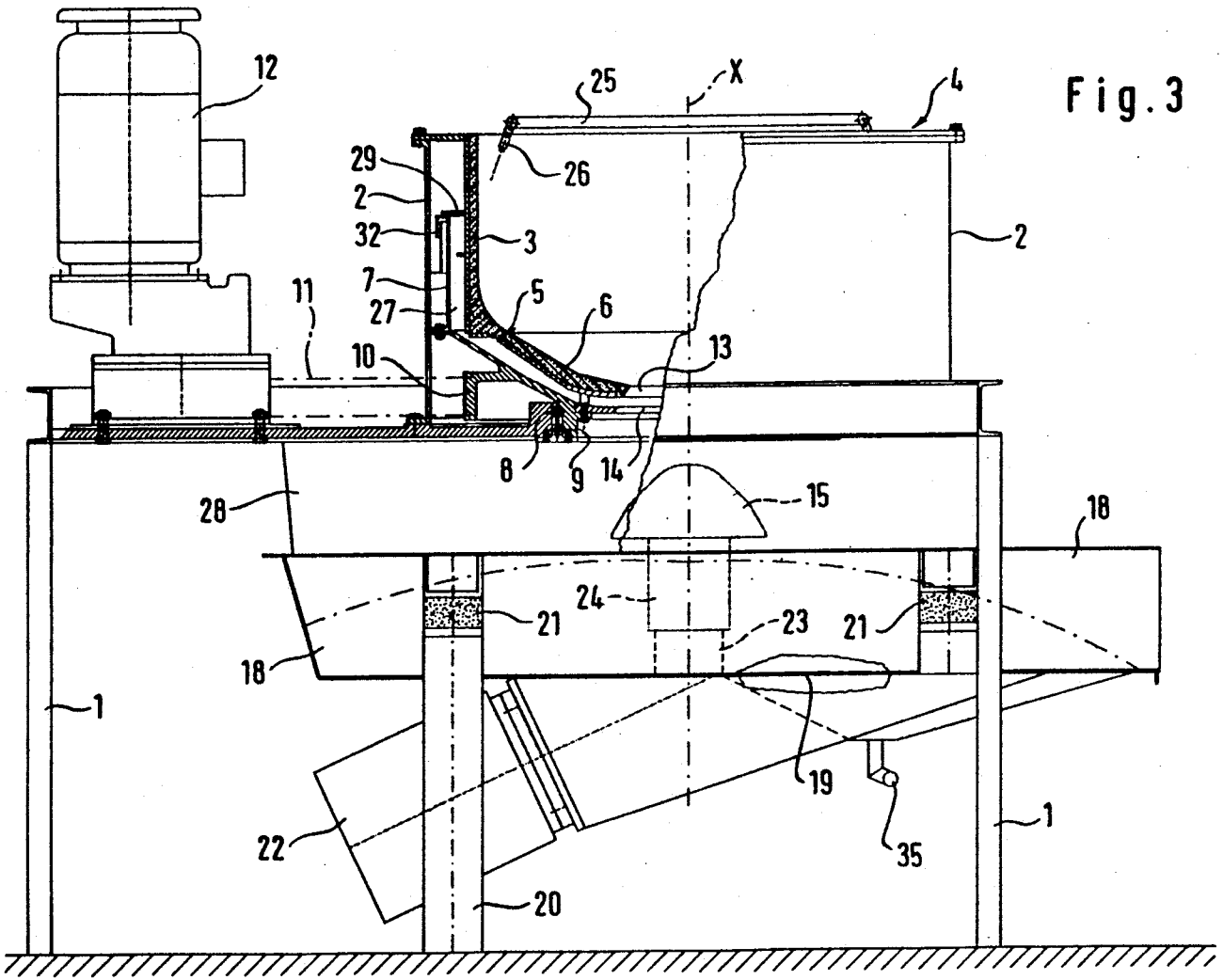

A particularly advantageous exemplified embodiment of the inventive machine which is described in more detail in the following is shown in the drawings, in which:

FIG. 1 shows a vertical cross-section through the whole centrifugal machine,

FIG. 2 equally shows this perspective, but only one half of the treatment container and the liquid container with supports on a larger scale, and FIG. 3 shows a partially sectioned machine with a drive for the rotating base of the treatment container.

In the exemplified embodiment shown in the drawings, an outer wall 2 rests on a machine frame 1, the fixed and substantially cylindrical casing 3 of the treatment container 4 being supported or braced at the upper rim of the outer wall 2. A rotatable base 6 of the treatment container in the form of a plate and supported coaxially to the casing extends to the lower rim of this casing forming a gap 5.

The treatment container 4 is surrounded by a liquid container 7 which is securely fixed at its base region to the rotating base 6 of the treatment container and is rotatable together with this about its rotational axis X. The liquid container has at its lower end a ring bearing 9 provided with a ball bearing 8 by means of which the liquid container 7 is rotatably supported on the machine frame 1 together with the rotating base 6.

For the rotational drive of the liquid container 7 together with the rotating base 6 of the treatment container 4, a drive ring 10 is also provided at the lower end of the liquid container, wherein a drive belt 11 extends about this which can be driven by means of the belt wheel of an electric motor 12.

Both the rotating base 6 of the treatment container 4 and the liquid container 7 securely fixed to the base have respective central openings 13 and 14 (FIG. 2/3) which are arranged beneath one another coaxially to the rotational axis X of the container base 6. Both of these, openings can be closed together by means of a plug in the form of a mushroom-like closure 15 which is seated on a raising and lowering bar 16 that is mechanically automatically raisable and lowerable within a guide 17 (by an activating means, not shown).

This raising and lowering bar 16 extends through a guide 17 (which is arranged beneath the base of the liquid container 7 and its supports 8, 9) and through a collecting receptacle 18 (arranged beneath this guide) and a hopper 28 (arranged above the guide 17). The guide 17 is secured to the fixed frame. The collecting receptacle 18 is formed as a vibrating trough with a screen base 19. The collecting receptacle 18 is supported on stands 20 via vibration cushions 21 and is vibrated by means of a vibrating drive 22. The collecting receptacle 18 is breached in the region of penetration of the raising and lowering bar 16, the raising and lowering bar being shielded from the inside of the receptacle 18 by means of a casing pipe 23 which surrounds the raising and lowering bar at a distance and is fastened to the base of the receptacle 18. At its upper end, this casing pipe 23 projects into a cylindrical collar 24 which is fastened to the lower end of the closure 15 and can be designed to be axially foldable.

A feed pipe 25 with an outlet nozzle 26 serves to feed the treatment liquid (water-compound mixture). The liquid introduced into the container is distributed in the inside of the container and the flow is ultimately channeled through the gap 5 into the space 27 between the treatment container 4 and the liquid container 7, wherein the space 27 channels the liquid and is therefore denoted as the "liquid space". The depth regulation of the liquid level in the treatment container 4 can ensue by means of the quantity of the liquid fed through the feed pipe 25 as well as by regulating the liquid quantity flowing out of the liquid container on account of centrifugal force.

As the liquid rises up the side wall of the liquid container 7 at a certain rotational speed of the container, devices in the form of rings 31 for holding back the rising liquid are provided on the outer side of the casing 3. Liquid flowing over the upper rim of the container 7 despite this can overflow into a fixed, ring-shaped collecting trough 33 extending about the liquid container and being formed by an angled wall 32 (see particularly FIG. 1 at the upper left), and flows from there via a fixed discharge pipe 34 for re-use or to the drainage. It is also possible to provide a single ring or ridge extending helically from the lower to the upper rim of the side wall of the liquid container on this container or on the casing 3 which ring favours the rise of the liquid at the side wall of the liquid container in one rotational direction thereof and impedes it in the other rotational direction. In order to be able to further limit and control the flow of liquid out of the liquid container 7, a web 29 extending about the casing 3 of the treatment container 4 above the rings 31 is provided which is adjustable in height on the casing and extends with its outer rim over the wall 32 forming the water overflow. Thus, a gap 30 is formed between this web 29 and the water overflow which is adjustable in height such that the quantity of liquid flowing over the overflow out of the liquid container 7 can be adjusted. The height adjustment of the web 29 on the casing 3 can be realised in such a manner than the gap 30 can be reduced practically to zero if none or virtually no quantity of liquid should flow out of the liquid container.

In accordance with the required rotational speed of the rotating base 6, it can be expedient to arrange the side wall of the co-rotating liquid chamber 7 to be inclined inwardly or outwardly rather than vertically in the depicted embodiment so that the increase in level of the liquid at this side wall can be restrained or increased. During the treatment of the workpieces in the treatment container 4, the container base 6 rotates together with the liquid container 7, the mushroom-shaped closure 15 closing the openings 13 and 14 respectively in the rotating base 6 and the rotating liquid container 7 in connection with its raising and lowering rod 16. In this case, the closure 15 lies with its conical side surface in sealing engagement against the facing edges of the openings 13,14 in both afore-mentioned rotating machining parts, which edges are aligned parallel to this surface. After treatment of the workpieces and in the case of a stationary or only slowly rotating container base 6, the closure can be moved in a steady manner by means of the raising and lowering rod 16 downwards as seen in the drawings out of the afore-mentioned openings into the open position shown in dashed lines in FIG. 1 and 3 such that both openings 13 and 14 are open. FIG. 2 shows the beginning of the opening movement. The liquid located in the treatment container 4 and the liquid container 7 flows together with the workpieces in the treatment container and possibly also the grinding means through these openings over the closure 15 into the collecting receptacle 18 formed as a vibration trough and flows out of this over the screen base 19 while the de-watered workpieces and possibly the grinding means are led off via the vibrating trough for further use or for separation. The liquid is discharged via a discharge line 35 either into a drainage, or for further use via appropriate circulating pumping tanks and filtering devices, or it is led to recycling treatment plants.

On account of the closure 15 being steadily movable into the open position, the drop for the workpieces into the collecting receptacle can be controlled so that damage to the workpieces while discharging these from the treatment container can be prevented.

A flushing out of the treatment container 4 can ensue via the liquid feeding conduit 25.

The inventive emptying of the treatment container through the base thereof has the advantage that relative to the container volume, a relatively small drop for the workpieces and the treatment means such as a water-compound mixture and grinding means ensues so that the danger of damage to the workpieces upon their discharge out of the treatment container can be reduced to a minimum. Since the treatment container is not required to be pivoted to empty the same, the conveying of liquid in the container can be such that dry operation is ensured.

What is claimed is:

1. Centrifugal treatment machine for mechanical surface treatment of workpieces, comprising a treatment container, having a substantially cylindrical casing which is stationary during operation and a rotatable base in the form of a dished plate mounted coaxially to this which rotates during operation and the circumferential edge of which projects towards the cylindrical casing forming a gap, a support means for the casing, a liquid collecting container for receiving liquid flowing through the gap out from the treatment container positioned beneath the treatment container, at least one opening in the rotatable base dimensioned for workpiece discharge out of the treatment container, co-rotating closure means for closing such opening, a receptacle located beneath the base opening for collecting workpieces and any treatment means discharged out of the treatment container; the closure means includes a closure plug, a raising and lowering bar seated thereon which bar extends downwardly from the closure plug away from the treatment container or upwardly through the treatment container, and activating means for pneumatically or mechanically raising and lowering said bar with the closure plug between closed and open positions.

2. Machine according to claim 1 for surface treatment of workpieces by at least one of grinding, polishing, cleaning and deburring, wherein only a single opening for workpiece discharge is provided in the rotatable base, the opening being arranged approximately coaxially to the rotational axis of the base.

3. Machine according to cliam 1, wherein the workpiece collecting receptacle is a vibrating conveyor with a screen base.

4. Machine according to claim 3, wherein the closure means comprises a closure plug, a raising and lowering bar seated thereon which bar extends downwardly from the closure plug away from the treatment container or upwardly through the treatment container, and activating means for pneumatically or mechanically raising and lowering the bar with the closure plug between closed and open positions.

5. Machine according to claim 2, wherein the raising and lowering bar of the closure means extends through the workpiece collecting receptacle.

6. Machine according to claim 5, wherein the workpiece collecting receptacle is shielded from the raising and lowering bar extended through it by means of a casing pipe which surrounds the raising and lowering bar at a distance and is secured to the collecting receptacle.

7. Machine according to claim 6, wherein the casing pipe projects with its upper end into a cylindrical collar which is provided at the under side of the closure means and is raisable and lowerable together with this closure means and the raising and lowering bar thereof with respect to the casing pipe.

8. Machine according to claims 7, wherein the closure means is dimensioned to fit into the discharge opening in the rotatable container base and be seated in this opening when in the closed position.

9. Machine according to claim 8, wherein the wall defined by the opening in the rotating base facing the closure means when seated extends parallel to the outer surface of the closure means sufficiently to effect a good fluid seal.

10. Centrifugal treatment machine for mechanical surface treatment of workpieces, comprising a treatment container, having a substantially cylindrical casing which is stationary during operation and a rotatable base in the form of a dished plate mounted coaxially to this which rotates during operation and the circumferential edge of which projects towards the cylindrical casing forming a gap, a support means for the casing, a liquid collecting container for the liquid flowing through the gap out of the treatment container positioned beneath the treatment container, at least one opening in the rotatable base dimensioned for workpiece discharge out of the treatment container, co-rotating closure means for closing such opening, a receptacle located beneath the base opening for collecting workpieces and any treatment means discharged out of the treatment container, a ring bearing rotatably supporting the rotatable base on the support means and extending about the discharge opening(s) .

11. Machine according to claim 10, wherein the outer diameter of the ring bearing lies between the peripheral diameter of the discharge opening(s) and the outer diameter of the rotating container base.

12. Machine according to claim 10, wherein the ring bearing has an outer diameter which lies in the vicinity of the outer diameter of the rotating container base.

13. Machine according to claim 10, comprising a driving ring fixed to the rotatable base surrounding the discharge opening(s) of the base, the surrounding ring being connectable with a drive for rotating the container base.

14. Centrifugal treatment machine for mechanical surface treatment of workpieces, comprising a treatment container, having a substantially cylindrical casing which is stationary during operation and a rotatable base in the form of a dished plate mounted coaxially to this which rotates during operation and the circumferential edge of which projects towards the cylindrical casing forming a gap, a support means for the casing, a liquid collecting container for the liquid flowing through the gap out of the treatment container positioned beneath the treatment container, at least one opening in the rotatable base dimensioned for workpiece discharge out of the treatment container, co-rotating closure means for closing such opening, a receptacle located beneath the base opening for collecting workpieces and any treatment means discharged out of the treatment container, the liquid collecting container is securely fixed to and rotatable together with the rotatable container base about the rotating axis of the base and has at least one opening beneath the rotating container base for the passage therethrough of the workpieces and treatment means to be discharged out of the treatment container.

15. Machine according to claim 14, wherein only a single discharge opening is provided in the base of the liquid collecting container, the opening being approximately coaxial to its rotational axis and the rotational axis of the rotatable base of the treatment container located there-above.

16. Machine according to claim 15, wherein the closure means for closing the single discharge opening in the rotatable base of the treatment container is constructed additionally to close the single opening therebeneath in the liquid collecting container.

17. Machine according to claim 14, wherein the liquid collecting container has limiting means on a side wall thereof for retarding any liquid rising up this wall during rotation of such liquid collecting container.

18. Machine according to claim 17, wherein the limiting means consists of at least one web-like ring arranged on one of the inner side of an outer side wall of the liquid collecting container and the outer side of the casing of the treatment container, the web-like ring extending in the peripheral direction of the container side wall.

19. Machine according to claim 14, wherein the liquid collecting container has a container side wall which extends parallel to the rotational axis of the container.

20. Machine according to claim 14, wherein the liquid collecting container has a side wall which is inclined in the direction towards such container's upper rim.

21. Machine according to claim 14, wherein the liquid container has a water overflow at the upper rim of its container side wall in a stationary collecting trough which extends about the liquid container, a discharge device being connected to the collecting trough.

22. Machine according to claim 21, wherein the web-like ring is adjustable in height to form an adjustable gap between this ring and the water over-flow.

23. Machine according to claim 1, wherein a liquid feed conduit for a water-compound mixture projects into the treatment container.

24. Machine according to claim 10, wherein the support means is a machine frame which carries the stationary casing and the ring bearing.

25. Centrifugal treatment machine for mechanical surface treatment of workpieces, comprising a treatment container, having a substantially cylindrical casing which is stationary during operation and a rotatable base in the form of a dished plate mounted coaxially to this which rotates during operation and the circumferential edge of which projects towards the cylindrical casing forming a gap, and a liquid collecting container for receiving liquid flowing through the gap out from the treatment container, the liquid collecting container being positioned essentially beneath the treatment container and being securely fixed to and rotatable together with the rotatable base about a common axis.

26. Machine according to claim 25, wherein the base and the liquid collecting container each have at least one opening therefrom for discharge of any liquid, treating means, and workpieces contained respectively therein, and further comprises co-rotating closure means for closing off such openings in the rotatable base and in the liquid collecting container, and a ring bearing mounted to support the liquid collecting container and being positioned thereon sufficiently remote from such openings to be free of impingement by liquids, treating means or workpieces discharged through such openings.

27. Machine according to claim 6, wherein the rotatable base of the treatment container has only a single opening and such opening is dimensioned for workpieces and any treatment means and residual liquid discharged out of the treatment container and is positioned approximately coaxially to the rotational axis of the base, the liquid collecting container similarly has only a single coaxial opening which is positioned beneath the rotatable base and is dimensioned for the passage therethrough of workpieces and any liquid and treatment means to be discharged directly or indirectly out of the treatment container, and further comprising a receptacle located beneath the opening of the liquid collecting container for collecting liquid from that container and any workpieces and treatment means discharged out of the treatment container.

28. Machine according to claim 27, wherein the closure means for closing the discharge opening in the rotating base of the treatment container is arranged simultaneously to close the opening therebeneath in the liquid container and has a concave shape which can be pushed from below into such discharge openings to close off such openings.

* * * * *

UNITED STATES PATENT AND TRADEMARK OFFICE

CERTIFICATE OF CORRECTION

PATENT NO. : 5,211,673

DATED : May 18, 1993

INVENTOR(S) : Friedhold Ditscherlein

It is certified that error appears in the above-identified patent and that said Letters Patent is hereby corrected as shown below:

On the title (cover) page of the printed patent after "[73] Assignee:", replace "Friedhold Ditscherlein" by --Max Spaleck GmbH & Co. KG--.

Signed and Sealed this

Twenty-eight Day of February, 1995

*Attest:*

Bruce Lehman

BRUCE LEHMAN

*Attesting Officer*

*Commissioner of Patents and Trademarks*